US005158821A

United States Patent [19]

Gebauer et al.

[11] Patent Number: 5,158,821

[45] Date of Patent: Oct. 27, 1992

[54] FORMABLE TEXTILE SHEET MATERIAL AND NETWORK MATERIALS PRODUCED THEREFROM

[75] Inventors: Elke Gebauer, Bobingen; Karlheinz Blaschke, Königsbrunn; Hermann Mildenberger, Bobingen, all of Fed. Rep. of Germany

[73] Assignee: Hoechst Aktiengesellschaft, Fed. Rep. of Germany

[21] Appl. No.: 555,082

[22] Filed: Jul. 19, 1990

[30] Foreign Application Priority Data

Jul. 21, 1989 [DE] Fed. Rep. of Germany ..... 3924150

[51] Int. Cl.[5] ..... B32B 1/00

[52] U.S. Cl. ..... 428/174; 428/175; 428/176; 428/178; 428/212; 428/225; 428/229; 428/253; 428/257; 28/156; 156/84

[58] Field of Search ..... 428/174, 175, 178, 253, 428/176, 225, 229, 212, 257; 28/156; 156/84

[56] References Cited

U.S. PATENT DOCUMENTS

| | | | |
|---|---|---|---|
| 4,357,385 | 11/1982 | Kuroda | 428/229 |
| 4,631,098 | 12/1986 | Pithouse | 428/229 |
| 4,631,221 | 12/1986 | Disselbeck | 428/253 |
| 4,704,757 | 11/1987 | Young | 428/253 |
| 4,761,321 | 8/1988 | McCall | 428/229 |
| 4,857,379 | 8/1989 | Plontges | 428/253 |

FOREIGN PATENT DOCUMENTS

| | | | |
|---|---|---|---|
| 3844458 | 7/1990 | Fed. Rep. of Germany . | |
| 32876 | 10/1979 | Japan | 428/229 |
| 17142 | 1/1985 | Japan | 428/253 |

*Primary Examiner*—Ellis P. Robinson
*Assistant Examiner*—Nasser Ahmad
*Attorney, Agent, or Firm*—Connolly & Hutz

[57] ABSTRACT

A formable textile material is described comprising a textile sheet material comprising at least two different kinds of polyester yarn, at least one of the yarns having a heat shrinkage at the boil of at least 45%, preferably at least 60%, and at least one of the yarns having a heat shrinkage of at most 10%, preferably at most 5%, in the shrunk and unshrunk state; further the formable textile material provided with a resin finish and a dimensionally stable network material produced therefrom.

Processes for producing these articles are also specified.

13 Claims, 1 Drawing Sheet

Fig. 1
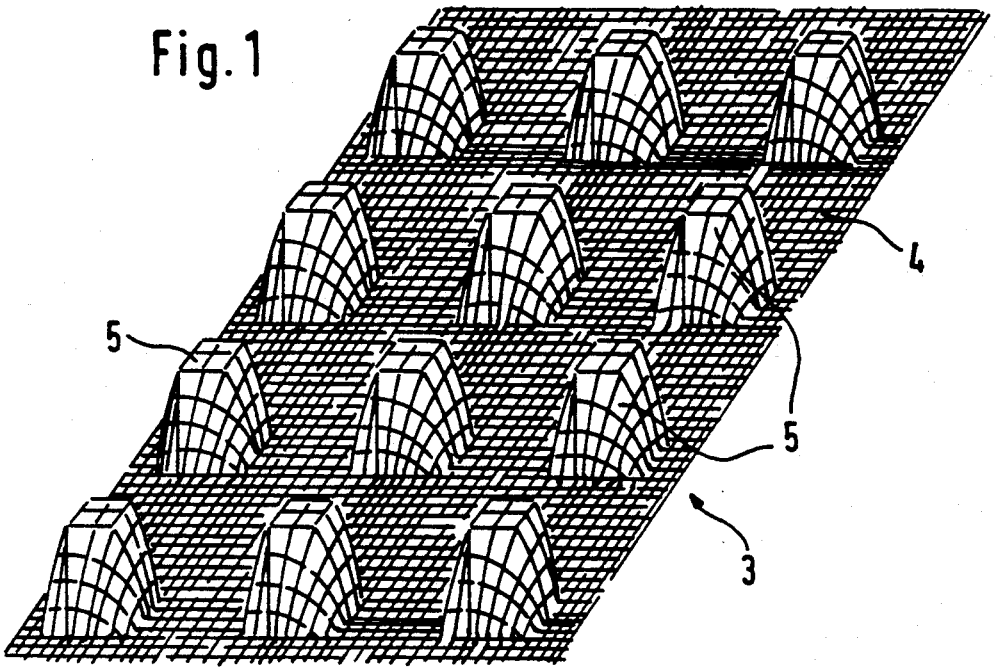
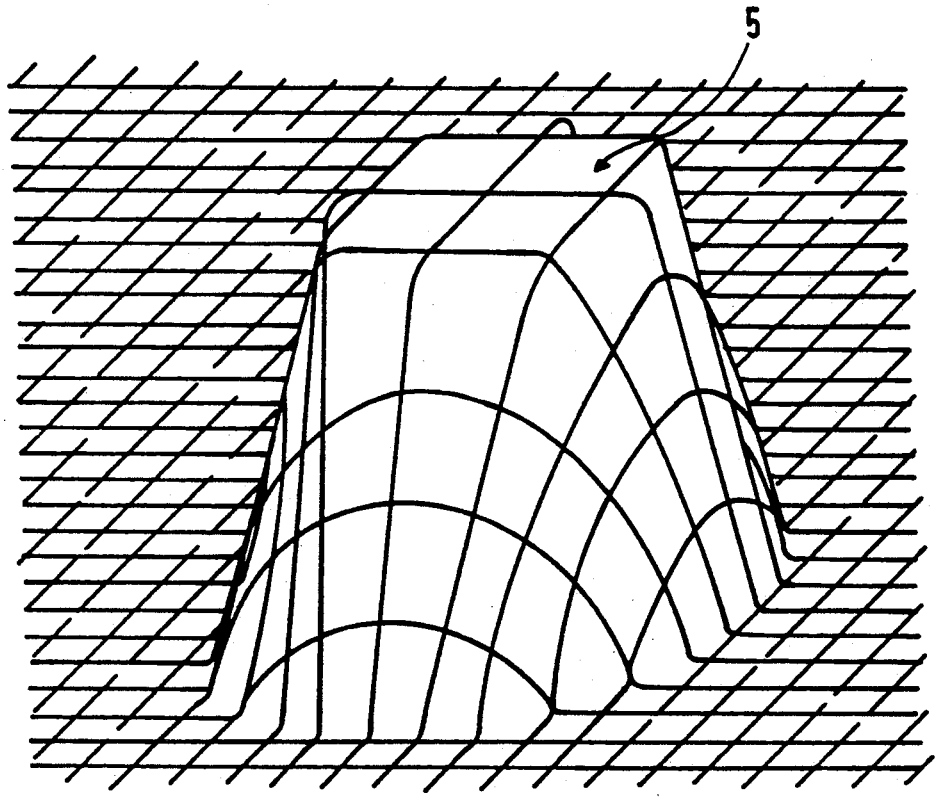
Fig. 2

FORMABLE TEXTILE SHEET MATERIAL AND NETWORK MATERIALS PRODUCED THEREFROM

The present invention relates to a deep-drawable sheet-like textile material and to network materials produced therefrom.

BACKGROUND OF THE INVENTION

An example of the use of such network materials in the form of a sandwich structure formed from two solid cover sheets and a core formed from a knitted fabric deep-drawn into a well structure and provided with synthetic resin is described in EP-A-158 234.

To produce such deep-drawable sheet materials, DE-A-3 844 458 (HOE 88/F 386) proposes a wrapped yarn composed of a core yarn of low stability and a high-tenacity sheath yarn.

The high stability of this textile material under normal handling and in finishing processes combined with a very good deep-drawability results from the advantageous structure of the material formed from the wrapped yarn. Under normal handling, and for example in the course of finishing processes, any tensile forces are absorbed by the core thread of the wrapped yarn, ensuring a high dimensional stability of the textile material. If, by contrast, considerably elevated tensile forces are exerted on the material in the course of a process of deep-drawing, the core threads of the wrapped yarn break at random places within the areas to be deformed and release a corresponding length of the sheath thread. This mechanism in response to deep-drawing permits an appreciable enlargement in area without destroying the integrity of the area as a whole.

The mechanism described can be further augmented by using core threads having a lower stability than the sheath filaments, i.e. by wrapping the core thread with a yarn which is the actual strength component but which is incorporated in the wrapped yarn in a distinctly greater length. On deforming the sheet material according to the invention, the core thread is destroyed by the mechanical stress, which may be accompanied by an additional thermostress, and/or by the effect of chemicals, and the previous sheath yarn is stretched and then takes over the load-bearing function in the sheet material.

Despite all their advantageous properties these sheet materials have the disadvantage that wrapped yarns are very expensive to manufacture.

SUMMARY OF THE INVENTION

It is an object of the present invention to provide a formable, e.g. deep-drawable, textile material which is inexpensive to produce.

The formable textile material according to the invention comprises a textile sheet material, for example a woven or preferably a knitted fabric, produced from at least two different kinds of yarn, at least one of the yarns having a heat shrinkage at the boil of at least 45%, preferably at least 60%, and at least one of the yarns having a heat shrinkage of at most 10%, preferably at most 5%. This formable textile material produced from at least two kinds of yarn will hereinafter be referred to for short as a multiyarn textile material, a multiyarn woven fabric or a multiyarn knitted fabric.

The yarns of the first kind and the yarns of the second kind are advantageously present in the formable textile materials in a mixing ratio of from 80:20 to 20:80, preferably from 60:40 to 40:60.

Yarns of the first kind generally have an elongation at break of from 80 to 200%. A preferred yarn of the first kind with a heat shrinkage of at least 45% is an undrawn high-speed POY yarn. Such yarns are customarily obtained at a high spin speed, which in the case of polyesters is about 2000 to 4000 m/min.

The yarns of the second kind are preferably yarns of high tenacity, in particular those having a tenacity of over 50 cN/tex. Highly useful yarns of the second kind are high-tenacity polyester yarns, for example ®TREVIRA HOCHFEST from HOECHST AG.

Furthermore, it is preferable for both types of yarn to consist of polyester, in particular polyethylene terephthalate.

Formable woven fabrics to be used according to the invention can be produced by uniformly mixing warp threads and/or weft threads from the two kinds of yarn in the abovementioned mixing ratio. If woven fabrics are to be used, it is advantageous if they have a very high thread slippage resistance.

When the formable textile material is, as preferred, a knitted fabric, it can equally be a warp-knitted as well as a weft-knitted fabric, but is in particular a warp-knitted fabric.

The stitch structures and tension settings on the warp knitting machines for manufacturing the warp-knitted fabric preferred according to the present invention depend primarily on the later use of the network material according to the present invention, to be precise on the desired depth of the three-dimensional shapes perpendicular to the base area of the textile sheet material, for example the well depth.

Highly extensible grades can be produced using two-bar structures in which the high-shrinkage yarn is used in guide bar 1 and the high-tenacity yarn in guide bar 2, for example

| | | |
|---|---|---|
| a. full tricot | GB1 = 1-0/1-2// | GB2 = 1-2/1-0// |
| b. slunglaid | GB2 = 0-0/1-2/0-0// | GB2 = 1-0/2-2/1-0// |

In the case of well structures for high compressive strength, i.e. for a high weight-bearing capacity, which are subjected to a high level of stress in use it is advisable to use a three-bar material of the following lapping notation:

GB1 = 1-2/0-0//
GB2 = 2-2/1-0//
GB3 = 3-4/1-1//

If weft-knitting is to be employed, it is possible to use dropstitch patterns in which the individual components are fed into the system separately or together, the feed in the case of two yarns being plated or arbitrary. They comprise R/L-constructions where loops and tuck loops can be formed in one course via one or two needles. It is possible here to use single-faced and double-faced circular knitting machines.

It is also possible to use pressoff patterns in which the individual components are fed separately or together to the knitting elements. They comprise double-faced constructions based on an interlock or check design. These sheet materials are produced on double-faced circular knitting machines.

The formable textile sheet materials according to the present invention and the network materials producible therefrom are thus produced by first producing in a conventional manner a "multiyarn textile material", for example a multiyarn woven fabric or preferably a multiyarn knitted fabric.

This multiyarn textile material is then subjected to controlled shrinkage in a conventional manner by controlled heat treatment, preferably within the range from 75 to 100° C. The linear shrinkage is adjusted through a choice of shrinkage temperature and heat treatment duration in such a way that it leads to the desired degree of deep-drawability of the multilayered textile material. This shrunk, multilayer textile material likewise forms part of the subject-matter of the present invention.

The shrunk multiyarn textile material obtained, which is preferably a knitted material, is subjected to forming into a desired three-dimensional structure, preferably by deep-drawing in the manner known from EP-A-158 234.

In the course of this forming operation, the shrinkage allowed in the shrink stage of the manufacturing process is essentially reversed. The low-shrinkage, strong component, whose loops have become bunched up, is straightened back out, so that the web portions of the loops are smoothed out and ensure a high level of compressive strength.

The heat treatment carried out to shrink the multiyarn textile material by a controlled amount can also be combined with other desirable, i.e. facultative, production operations.

For instance, it is possible to carry out a possibly desirable finishing of the textile material with, for example, strength-enhancing resins, adhesion promoters for rubber and the like under temperature conditions at which the desired shrinkage occurs.

The network materials with, for example, well structures obtained on three-dimensional forming, preferably by deep-drawing, can, as mentioned above, be used for many purposes without further reinforcement since they already exhibit excellent dimensional stability. For instance, they can be filled for example with concrete or foams. However, it is also possible, if a particularly high compressive strength of the network materials themselves is desirable, to additionally consolidate and stabilize them by impregnating the multilayer textile material with a resin.

The shape-stabilizing resins present in the network materials according to the present invention can belong to the various known thermoplastic or thermosetting resins as long as their mechanical properties permit the dimensional stabilization of the network materials according to the present invention. Examples of suitable thermoplastic resins are polyacrylates and polyvinyl chloride; however, the preferred resins are thermosetting resins, for example melamine and in particular phenolic resins.

The amount of resin present in the three-dimensionally shaped network materials according to the present invention is preferably adapted t the weight of the textile material in such a way that deep-drawing of the sheetlike textile material causes the mesh structure to open up to form a filigree network. Suitable addon levels range from 50 to 500, preferably from 100 to 300, g of resin/$m^2$ of the unstretched textile material. Within these specified ranges the amount of resin is advantageously also adapted to the square meter weight of the deep-drawable textile material. Thus, if a heavyweight textile material is used, the amount of resin employed will be in the upper half of the stated ranges, while in the case of light-weight textile materials it will be within the lower half. The pivotal criterion is, as stated above, the condition that on deep-drawing the mesh structure of the textile material should open up to form a network. For specific purposes it is also possible to employ higher amounts of resin, so that the holes in the mesh structure are sealed by the resin.

The three-dimensionally shaped network material according to the present invention exhibits a multiplicity of deformations which extend at least in one direction which has a component perpendicular to the original plane of the textile sheet material from which the network material according to the present invention was produced.

In a specific embodiment which is particularly useful for a later use as a core material for the manufacture of sandwich structures, the network material according to the present invention exhibits a multiplicity of elevations in a regular pattern on a base area. In a further embodiment, the network material according to the present invention exhibits a multiplicity of elevations and depressions in a regular pattern on the plane of the original base area. The elevations and depressions can take the form of wells having round or angular base area or for example the form of webs. From the aspect of good adhesion between the network material according to the present invention to be used as a core material for sandwich articles and applied cover surfaces, it is particularly advantageous for the elevations to have a flat top and for the depressions to have a flat bottom. It is also particularly preferable if all the top surfaces of the elevations and the bottom surfaces of the depressions are within one plane and parallel to the base area. It is also of advantage from the aspect of good adhesion between the core material and applied cover surfaces if the number, size, shape and spatial arrangement of the deformations per unit area of sheet material are selected in such a way as to maximize the arithmetic product of the area parameters of the original plane and the size of the top surfaces of the elevations and the bottom surfaces of the depressions.

BRIEF DESCRIPTION OF THE DRAWINGS

FIG. 1 shows schematically a section of a novel network material (3) with a multiplicity of hat-shaped elevations (5) on a base area (4).

FIG. 2 schematically depicts in enlargement one of the hat-shaped deformations and clearly shows the dramatic widening of the mesh structure of the textile material which occurs in the area of the deformation.

DETAILED DESCRIPTION OF THE INVENTION

For other uses it is of course also possible for the network material according to the present invention to exhibit other three-dimensional deformations. It is also entirely possible for the surface of the original textile material to disappear completely in the three-dimensionally shaped network material according to the present invention if, for example, the material is deep-drawn with rams from both sides of the textile material in such a way that well- and hat-shaped deformations alternate up and down in the material or if the original textile material is pulled out from both sides by a multiplicity of narrow rams which extend in the same longitudinal direction to form a zig-zag surface and is stabilized in this form.

To produce a three-dimensionally shaped, resinized network material according to the present invention, first the shrunk multiyarn textile material is impregnated with one of the abovementioned strength-increasing resins. The resin can be applied to the textile material in a conventional manner by brushing, rubbing, knife-coating, padding or particularly advantageously by dipping. The resin-treated fabric is then advantageously squeezed off to the desired resin pickup with a pair of squeeze rolls. Thermoplastic resins are advantageously in the form of solutions or preferably emulsions for the impregnating step. Heat-curable or thermosetting resins are advantageously applied in the commercial form as highly concentrated aqueous solutions or dispersions.

After a possible intermediate drying of the resin-impregnated textile material, it is subjected to the process of deep-drawing at elevated temperature. The deep-drawing temperature is chosen in such a way that thermoplastic resins are melted and completely penetrate the filaments of the net structure. The same is true of thermosetting resins. In this case the temperature of the deep-drawing means is adjusted in such a way that the flowable domain of the thermosetting resin is reached. After the resin has melted, the temperature of the deep-drawing means is controlled in such a way that the impregnating resin can harden. If thermoplastics are used, this requires the temperature to be reduced to below the melting point of the thermoplastics; in the case of thermosetting resins, the temperature of the deep-drawing apparatus can in general remain unchanged since the hardening of thermosetting resins also takes place at elevated temperature. The deep-drawing means is kept closed until the stabilizing resin is completely hard. Alternatively, the hardening of the thermosetting resin can also take place in a heating oven.

Since the resin is not necessary for stabilizing the deep-drawn structure but only for conferring a possibly desired additional reinforcement, any resins can also be applied after the deep-drawing operation.

The present invention further provides a sheetlike sandwich article comprising two outer firm cover layers which are connected to one another via a core comprising the above-described network material according to the present invention. The core material used for this purpose is the above-described network material particularly preferred for manufacturing sandwich structures which, on a base area, exhibits a multiplicity of elevations with flat tops which are within one plane. The top surfaces of the elevations and the bottom surfaces of the depressions of the core material according to the present invention can be bonded to the cover layers by conventional laminating techniques involving the use of adhesives, in particular cold- or hot-curing adhesives, for example epoxy resins or thermosetting resins. Owing to the large area of contact between the core material and the cover layers, the adhesive join proves to be remarkably stable. Despite the preferred filigree structure of the core material according to the present invention, the sandwich articles produced therewith combine a surprisingly highly compressive strength with an extremely low weight.

The above-described manufacturing process can be varied by not impregnating the fabric with resin in the usual manner but processing the deep-drawable textile material together with a commercial resin film. This method comprises stacking one or more layers of a deep-drawable textile material and one or more resin films on top of one another, bringing the stack into the desired shape by deep-drawing at a temperature in which the resin becomes fluid, and then adjusting the temperature in such a way that the resin can flow and impregnates the textile material. The resin films used in this process can likewise consist of thermoplastic or thermosetting resins. Here too the preference is in particular for thermosetting resins, i.e. those resins which at elevated temperature crosslink to form an infusible material of high stiffness. Known resins of this type which are also commercially available in the form of films are for example unsaturated polyester resins (alkyd resins), mixtures of unsaturated polyesters with unsaturated monomeric compounds, for example styrene, epoxy resins, phenolic resins and melamine resins. As mentioned above, the resins in the form of films are also commercially available, and applied, in the uncrosslinked state in which they are still fusible and flowable at elevated temperature. The films of uncrosslinked resins to be used in this embodiment of the process for producing network materials according to the present invention range in thickness from about 50 to 500 $\mu$m, preferably from 100 to 500 $\mu$m, and have a basis weight of from about 50 to 500 g/m$^2$, preferably 100 to 500 g/m$^2$. The use of these resins in the specified film thickness produces approximately the same degree of resin impregnation as the above-described technique of applying liquid resin formulations by conventional impregnating.

The temperature at which the uncrosslinked resin melts is in general within the range from 100 to 250° C., preferably from 140 to 200° C.

Textile sheet materials which are produced from the high-shrinkage high-speed yarn alone show uncontrolled stretching on deep-drawing and serious strength fluctuations resulting therefrom. The "multiyarn textile materials" according to the present invention, by contrast, do not give rise to any strength fluctuations.

In addition to having a stabilizing effect on the shrunk multiyarn textile material, the stretch- and shrinkage-yarn grade controls the density of the textile material. Its high shrinkage level results in a high level of latent extensibility for the deep-drawing operation combined with good mesh density. In choosing the pattern a high extensibility of the fabric construction is therefore no longer of decisive significance.

It is a further advantage of the present invention that the shrunk multiyarn textile material shows increased stability in any impregnating and finishing steps.

We claim:

1. A formable textile material comprising a planar textile sheet material comprising threads which comprise a uniform mixture of at least two different kinds of yarn, at least one of the yarns having a heat shrinkage at the boiling temperature of water of at least 45%, and at least one of the yarns having a heat shrinkage at the boiling temperature of water of at most 10%.

2. The formable textile material as claimed in claim 1, wherein the textile sheet material is a knitted fabric.

3. The formable textile material as claimed in claim 1, wherein the yarn having a heat shrinkage of at least 45% is a high-speed yarn.

4. The formable textile material as claimed in claim 1, wherein the yarn having a heat shrinkage of below 10% is a high-tenacity yarn.

5. The formable textile material as claimed in claim 1, wherein the yarns consist of polyester.

6. The formable textile material as claimed in claim 1, which is present in the shrunk state.

7. The formable textile material as claimed in claim 1, which has been provided with a finish.

8. A three-dimensionally deformed, dimensionally stable network material based on a formable textile material, wherein the textile material is one of claim 1, the network material forms an open-mesh three-dimensional net structure, and the deformations extend at least in one direction which has a component perpendicular to the original plane of the sheet material and the deformations have the shape of wells or webs which each preferably possess a new plane which extends parallel to the original plane of the sheet material.

9. A process for producing the formable textile material of claim 1, which comprises processing at least two kinds of yarn, of which at least one of the yarns has a heat shrinkage at the boiling temperature of water of at least 45% and at least one of the yarns has a heat shrinkage at the boiling temperature of water of at most 10% into a textile sheet material.

10. The process as claimed in claim 9, wherein the two kinds of yarn are processed into a woven fabric.

11. The process as claimed in claim 9, wherein the textile sheet material produced is shrunk at elevated temperature.

12. A process for producing a three-dimensionally deformed, dimensionally-stable network material, which comprises three-dimensionally deforming a formable textile material of claim 1 in the desired manner by deep-drawing or a similar shape-giving process.

13. A sandwich article formed from a core material and two cover sheets, wherein the core material comprises the network material of claim 8.

* * * * *